US008894330B2

(12) United States Patent
Gluch et al.

(10) Patent No.: US 8,894,330 B2
(45) Date of Patent: Nov. 25, 2014

(54) METHOD AND DEVICE FOR DISTRIBUTING CUT TOBACCO FOR FEEDING CIGARETTE-MAKING MACHINES

(75) Inventors: Krzysztof Jan Gluch, Radom (PL); Tomasz Jan Kramek, Radom (PL); Krzysztof Andrzej Natora, Radom (PL)

(73) Assignee: International Tobacco Machinery Poland Sp. Z o.o., Radom (PL)

( * ) Notice: Subject to any disclaimer, the term of this patent is extended or adjusted under 35 U.S.C. 154(b) by 475 days.

(21) Appl. No.: 13/319,838

(22) PCT Filed: May 13, 2010

(86) PCT No.: PCT/EP2010/056633

§ 371 (c)(1),
(2), (4) Date: Nov. 10, 2011

(87) PCT Pub. No.: WO2010/130822

PCT Pub. Date: Nov. 18, 2010

(65) Prior Publication Data

US 2012/0060967 A1 Mar. 15, 2012

(30) Foreign Application Priority Data

May 14, 2009 (PL) ..... P.388020

(51) Int. Cl.
*B65G 51/18* (2006.01)
*A24C 5/39* (2006.01)

(52) U.S. Cl.
CPC ..... *A24C 5/391* (2013.01)
USPC ..... 406/181

(58) Field of Classification Search
CPC ..... B65G 53/528
USPC ..... 406/181; 137/561 A; 111/175
See application file for complete search history.

(56) References Cited

U.S. PATENT DOCUMENTS 1,825,668 A * 10/1931 Kennedy ..... 406/181
1,871,853 A * 8/1932 Kennedy ..... 406/181
2,812,732 A * 11/1957 Meisdalen ..... 111/52

(Continued)

FOREIGN PATENT DOCUMENTS

DE 1100526 2/1961
DE 3526503 A1 1/1987

(Continued)

OTHER PUBLICATIONS

International Search Report for Application No. PCT/EP2010/056633 dated Aug. 31, 2010.

(Continued)

*Primary Examiner* — Joseph Dillon, Jr.
(74) *Attorney, Agent, or Firm* — Marshall, Gerstein & Borun LLP

(57) ABSTRACT

A method and a device for distributing cut tobacco for feeding cigarette-making machines. The distributing device is equipped with a distribution chamber having a bottom, with a feeding channel for feeding the cut tobacco to the distribution chamber, the channel being connected to the chamber from above, with at least one receiving channel for receiving the cut tobacco from the distribution chamber, the receiving channel being connected to the chamber at side walls thereof. A rotary element for changing local bulk density and disturbing the flow of the cut tobacco fed to the distribution chamber is eccentrically mounted to a stationary bottom of the distribution chamber.

14 Claims, 4 Drawing Sheets

(56) References Cited

U.S. PATENT DOCUMENTS

| | | | | |
|---|---|---|---|---|
| 2,987,064 | A | 6/1961 | Peters | |
| 3,189,230 | A * | 6/1965 | Gillespie | 406/127 |
| 3,652,131 | A * | 3/1972 | Carlsson | 406/181 |
| 3,949,908 | A * | 4/1976 | Baillie | 406/181 |
| 4,264,242 | A * | 4/1981 | Lecomte | 406/155 |
| 4,390,029 | A | 6/1983 | Leckband et al. | |
| 4,413,935 | A * | 11/1983 | Smith et al. | 406/181 |
| 4,463,583 | A * | 8/1984 | Kruger et al. | 68/205 R |
| 4,530,462 | A * | 7/1985 | Andersson | 239/7 |
| 4,562,968 | A * | 1/1986 | Widmer et al. | 239/655 |
| 5,101,847 | A * | 4/1992 | Oribe | 137/1 |
| 5,241,867 | A * | 9/1993 | Cohen et al. | 73/863.41 |
| 5,271,567 | A * | 12/1993 | Bauer | 239/662 |
| 5,333,640 | A * | 8/1994 | Swift et al. | 137/262 |
| 5,645,381 | A * | 7/1997 | Guidetti et al. | 406/156 |
| 6,202,942 | B1 * | 3/2001 | Hultgreen et al. | 239/214.15 |
| 6,273,648 | B1 * | 8/2001 | Poncelet et al. | 406/181 |
| 6,827,529 | B1 * | 12/2004 | Berge et al. | 406/28 |
| 7,555,990 | B2 * | 7/2009 | Beaujot | 111/123 |
| 8,678,030 | B2 * | 3/2014 | Knodel | 137/561 A |
| 2001/0052346 | A1 * | 12/2001 | Vuilleumier et al. | 131/109.1 |
| 2011/0079304 | A1 * | 4/2011 | Knodel | 137/561 A |
| 2012/0255635 | A1 * | 10/2012 | Banda et al. | 137/561 A |

FOREIGN PATENT DOCUMENTS

| | | | |
|---|---|---|---|
| DE | 19823873 | A1 | 12/1999 |
| EP | 0568868 | A1 | 11/1993 |
| FR | 1321968 | | 3/1963 |
| FR | 1454251 | | 7/1966 |
| GB | 1097990 | | 1/1968 |
| GB | 1103339 | | 2/1968 |
| PL | 188776 | B1 | 11/1997 |

OTHER PUBLICATIONS

International Preliminary Report on Patentability for Application No. PCT/EP2010/056633 dated Mar. 30, 2011.

Polish Search Report for Application No. P-388020 dated Jun. 25, 2009.

* cited by examiner

METHOD AND DEVICE FOR DISTRIBUTING CUT TOBACCO FOR FEEDING CIGARETTE-MAKING MACHINES

CROSS-REFERENCE TO RELATED APPLICATIONS

This is the U.S. National Stage of International Patent Application No. PCT/EP2010/056633, having an international filing date of May 13, 2010, and which claims priority to Polish Application No. P.388020, filed May 14, 2009, the contents of each of which are expressly incorporated herein by reference.

FIELD OF THE DISCLOSURE

This disclosure relates to a method and a device for distributing cut tobacco for feeding cigarette-making machines. Most often, in tobacco industry factories the feeding step for the cigarette-making machines is carried out pneumatically—cut tobacco is transported from a distributing device to hoppers located inside the cigarette-making machines. In the mass-production conditions a plurality of cigarette-making machines may be fed by a single distributing device.

BACKGROUND

From DE 1 103 216 a device for distributing cut tobacco to cigarette-making machines is known, wherein the cut tobacco is fed from a conveyor onto a rotary table from which the tobacco is drawn by stationary sucking pipes spaced at the periphery of a table constituting a distributing element, the cut tobacco fed from the conveyor falling onto a cone located centrally relative to the rotary table. The cut tobacco slides down along the cone onto the rotary table gravitationally and then it is transported due to the centrifugal force as a layer towards the periphery of the table, from where it is sucked by vertical pipes to deliver the cut tobacco to the cigarette-making machines.

DE 198 23 873 presents a similarly operating device for feeding cut tobacco to many machines. The cut tobacco is fed via a vertical channel onto a bowl performing a composed, rotary and circulating, motion. The sucking channels, picking up the cut tobacco from the uniformly formed layer, are arranged vertically within the bowl cover at the bowl periphery.

In GB 959 343 a device is described in which the cut tobacco is fed, as previously, from above onto a rotary distribution disk and is directed by the centrifugal force towards receiving channels arranged radially in the side wall of the distribution chamber.

In a slightly different arrangement, known from DE 300 90 000, cut tobacco is fed through a charging hopper onto a linear vibrational conveyor. The vibrational conveyor transfers the fed cut tobacco to a place above which sucking pipes are situated. The cut tobacco is transported in the form of a layer and the sucking pipes are arranged vertically just above the surface of this layer.

Usually the bottom of the distribution chamber is flat or has the shape of a bowl and it is a surface of revolution and posses a centrally located rotational cone.

The process of feeding the cut tobacco to the cigarette-making machines is discontinuous, the result of which is that the more receiving channels are connected, the more frequent changes of the flow rate of the tobacco through the distributing device will occur. The discontinuity of the feeding process results from the fact that after filling the cut tobacco container located within the machine, the feeding is stopped until the amount of the cut tobacco in the container drops below a certain predefined level, afterwards the feeding is started again. Devices for distributing cut tobacco, employed in the tobacco industry, usually feed a lot of cigarette-making machines. Every change in a total throughput of the receiving channels will result, as a consequence, in a change of the efficiency of the conveyor feeding the distributing device.

All the solutions presented above relate to devices for distributing cut tobacco to cigarette-making machines using gravitational feeding, usually in the form of a feeding channel and a couple of pneumatic receiving channels transferring the cut tobacco to the cigarette-making machines, the receiving channels being connected to the distributing chamber or being located at the periphery of the distributing element for uniform distributing the cut tobacco into the inlets of the receiving channels. For proper operation of all the above devices it is necessary to collect some amount of the cut tobacco in the distribution chamber, which is transferred to the space from which it is received by the receiving channels. During transferring the layer of the cut tobacco gains its optimal thickness in order to ensure repeatable conditions of receiving the cut tobacco by the receiving channels. Therefore the receiving channels are distant from the feeding channel. In each of the devices in the case of temporary stopping the process of feeding the cigarette-making machines, the amount of the cut tobacco, which has been already delivered to the distributing device but has not been yet received, is an excess of the cut tobacco present in the device relative to the amount necessary for its operation. The cut tobacco tends to agglomerate, i.e., to create bundles, the effect of the agglomeration being particularly strong if the cut tobacco is stored in a high layer, as in the vertical channel feeding the distributing device.

If the process of receiving the cut tobacco by the cigarette-making machines, connected to a single distributing device, is stopped, one must stop the conveyor feeding the device, which was operating with a rate adjusted for feeding all the cigarette-making machines. However, due to inertia of the system, the distribution chamber will be filled anyway as well as, partially or fully, then vertical feeding channel. Restarting the device after a longer downtime may occur difficult, since the bulk density of the cut tobacco collected and stored under a pressure within the feeding channel increases and it is significantly more difficult to form a uniform layer of the cut tobacco and to suck the agglomerated tobacco through the receiving channels. Sometimes, in order to restart the feeding system the agglomerated tobacco must be removed from the lower portion of the feeding channel and partially from the distribution chamber.

If a couple of receiving channels will be shut off simultaneously, i.e., in the case of a rapid drop of the received amount of the cut tobacco, an excess of the cut tobacco will arise within the distribution chamber. The efficiency of the conveyor feeding the distributing device will be adjusted to the throughput of the cigarette-making machines that are still working, and the excess of the collected cut tobacco will be used by those machines, however if the excess is relatively large, disturbances in the receiving process may arise.

Frequently, cigarette manufacturers must face the task of producing short series of new cigarette brands. Large distributing devices with rotary tables or vibrational conveyors are expensive and there is no economical justification for using them in the case of frequent changes of the brand of tobacco fed to one or two cigarette-making machines.

General Description

This disclosure provides a method of distributing cut tobacco for feeding cigarette-making machines wherein the cut tobacco is fed to a distribution chamber via a feeding channel and received from the distribution chamber by at least two receiving channels which feed cigarette-making machines, and the efficiency of the feeding via the feeding channel and the total receiving throughput of the receiving channels are temporarily different resulting in a temporary excess of cut tobacco collected in the distribution chamber, the method being characterized in that the cut tobacco is fed to the distribution chamber onto an eccentrically mounted rotary element for changing the local bulk density and disturbing the flow of the cut tobacco, the element rotating about the distribution chamber axis of symmetry, essentially perpendicular to a bottom of the distribution chamber, and the local bulk density of the cut tobacco is changed directly before feeding it to the receiving channels.

Preferably, just before feeding the cut tobacco to the receiving channel, the flow of air and the cut tobacco is disturbed, as a result of which turbulences of the flows are produced and no deposition of the cut tobacco within the distribution chamber occurs.

Preferably, the element for changing the local bulk density and disturbing the flow of the cut tobacco rotates about the axis, which is coincident with the axis of symmetry of the distribution chamber.

Preferably, the rotational speed of the element is 40-120 rpm, more preferably 80 rpm.

According to the disclosure a device is provided for distributing cut tobacco for feeding cigarette-making machines, which is equipped with a distribution chamber having a bottom, with a feeding channel for feeding the cut tobacco to the distribution chamber, the channel being connected to the chamber from above, with at least one receiving channel for receiving the cut tobacco from the distribution chamber, the receiving channel being connected to the chamber at the chamber side walls, the device being characterized in that a rotary element for changing the local bulk density and disturbing the flow of the cut tobacco fed to the distribution chamber is eccentrically mounted in the distribution chamber to its stationary bottom.

The element for changing the local bulk density and disturbing the flow of the cut tobacco has a form of a cone.

Preferably, the element for changing the local bulk density and disturbing the flow of the cut tobacco has the form of a rod arranged essentially horizontally.

Preferably, the element for changing the local bulk density and disturbing the flow of the cut tobacco is an element in a form of a cone and a rod arranged essentially horizontally and connected to the cone.

Preferably, the element for changing the local bulk density and disturbing the flow of the cut tobacco is an element being a combination of a prism having a triangular base and a cone cut with a plane passing through its axis of rotation, the corresponding halves of the cone being adjacent to corresponding bases of the prism.

In an optional embodiment the element for changing the local bulk density and disturbing the flow of the cut tobacco has the form of an inclined cone.

One end of the rod is located in the vicinity of the wall of the distribution chamber.

The distance between the axis of the element for changing the local bulk density and disturbing the flow of the cut tobacco and the symmetry axis of the distribution chamber is in the range of 15-50 mm, preferably is 32 mm.

Preferably the axis of rotation of the element for changing the local bulk density and disturbing the flow of the cut tobacco is coincident with the symmetry axis of the distribution chamber.

An apex angle of the cones is in the range from 80° to 150°, preferably is 120°.

The disclosure relates to a method for distributing cut tobacco for feeding cigarette-making machines, wherein the cut tobacco is fed to a distribution chamber via a feeding channel and received from the distribution chamber by a plurality of receiving channels which feed the cigarette-making machines, the efficiency of feeding via the feeding channel and the total receiving throughput of the receiving channels being temporarily different. According to the invention, directly before feeding the cut tobacco to the receiving channels the local bulk density of the cut tobacco fed to the distribution chamber is changed.

The device for distributing the cut tobacco according to the disclosure ensures that directly before feeding it to the receiving channels the cut tobacco has bulk density uniformed for easy drawing the cut tobacco from the distribution chamber with a vacuum, irrespective of temporary differences between the efficiency of feeding through the feeding channel and the total receiving throughput of the receiving channels, which can result in accumulation of excess cut tobacco in the distribution chamber. Uniforming the bulk density of the cut tobacco uniforms the conditions in which the receiving channels draw the cut tobacco, ensuring stable the conditions in which the device operates. The collected amount of excess cut tobacco within the distribution chamber may have nonuniform bulk density, however due to the mobile elements for changing the local bulk density, the bulk density of the cut tobacco is uniformed just before providing it to the receiving channels. If the distributing device was switched off and some amount of the cut tobacco has been left therein, and, moreover, the cut tobacco has been left also within the feeding channel, there is no need to remove it manually because it will be loosen and easily fed to the receiving channels thanks to the decrease of the bulk density.

The device according to the disclosure ensures that no deposits of agglomerated cut tobacco are formed within the distribution chamber, even if only one receiving channel is used at a moment. The rotary elements for changing the local bulk density and disturbing the flow of the cut tobacco ensure that the cut tobacco will not accumulate in the region opposite to the working receiving channel.

Cut tobacco delivered to cigarette-making machines, due to its unavoidable degradation, may comprise some small fractions as well as tobacco dust, which tend to deposit on the walls of transporting devices. The changes of the flow intensities of the cut tobacco and the air as well as turbulences generated thereby prevent the deposition of small fractions within the distribution chamber.

Using the device according to the disclosure is more justified from the economical point of view than using large distributing devices if there is a need of feeding one or two cigarette-making machines. The device according to the invention makes it possible to produce short series of cigarettes elastically, because it is a simple solution, which enables to connect a single silo with cut tobacco to a single cigarette-making machine.

BRIEF DESCRIPTION OF DRAWINGS

The invention will be discussed in reference to an embodiment shown in the following drawings in which.

DETAILED DESCRIPTION

Figure 1:
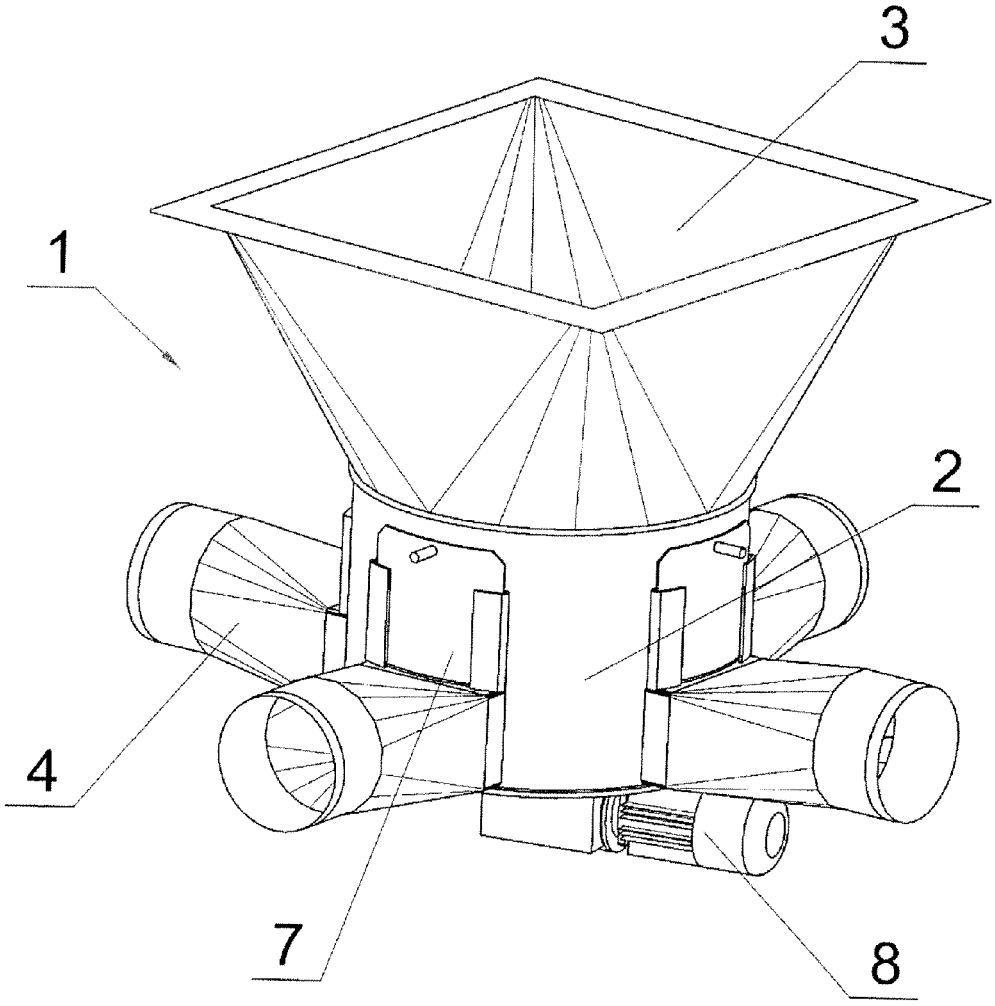
FIG. 1 shows a perspective view of a device for distributing cut tobacco.

In a method for distributing cut tobacco for feeding cigarette-making machines the cut tobacco is fed to a distribution chamber 2 via a feeding channel 3 and is received from the distribution chamber by at least two receiving channels 4 which feed the cigarette-making machines, while the efficiency of the feeding process by the feeding channel and the total receiving throughput of the receiving channels are temporarily different, this difference generating a temporary excess of the cut tobacco within the distribution chamber. In this solution the cut tobacco is fed to the distribution chamber 2 onto an eccentrically mounted rotary element for changing the local bulk density and disturbing the flow of the cut tobacco, rotating about an axis essentially perpendicular to the bottom of the distribution chamber 2, and the local bulk density of the cut tobacco is changed just before delivering the cut tobacco to the receiving channels. According to this method, after starting the element for changing the local bulk density and disturbing the flow of the cut tobacco, the cut tobacco deposited in the distribution chamber 2 is loosened, an air-tobacco mixture is formed which is then sucked via the receiving channels 4.

According to the disclosure, just before delivering the cut tobacco to the receiving channel 4, the flows of the air and the cut tobacco is disturbed, as a consequence of which turbulences are generated and the cut tobacco does not deposit in the distribution chamber. In this solution, after starting the element for changing the local bulk density, the air-tobacco mixture flows through the distribution chamber 2 in a continuous manner.

The rotational speed of the element for changing the local bulk density and disturbing the flow of the cut tobacco is 40-120 rpm, preferably 80 rpm.

The space within which the element for changing the local bulk density and disturbing the flow of the cut tobacco performs its motion during its revolutions has a volume, e.g., 50% bigger than the volume of the element itself, resulting in stirring the layer of the cut tobacco.

FIG. 1 shows a distributing device 1 having a distribution chamber 2 situated beneath a feeding channel 3 to which the cut tobacco is fed from a cut tobacco conveyor (not shown). Four receiving channels 4 are radially located on the distribution chamber 2, each of the receiving channels having a valve 5 which may be moved vertically and makes it possible to cut off the receiving channel 4 temporarily.

Figure 2:
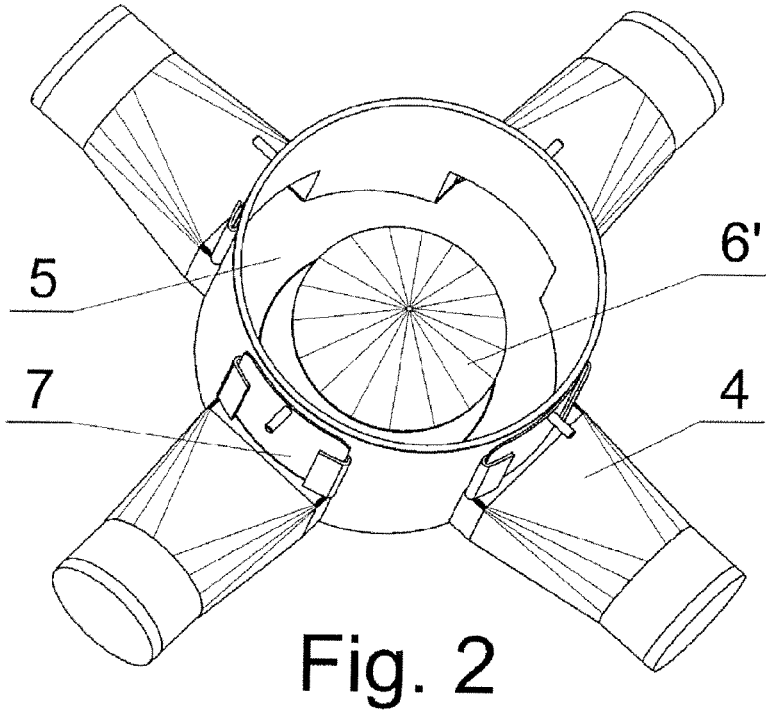
FIG. 2 shows a perspective view of a distribution chamber with an element for changing the local bulk density and disturbing the flow of the cut tobacco in the form of a cone.
Figure 3:
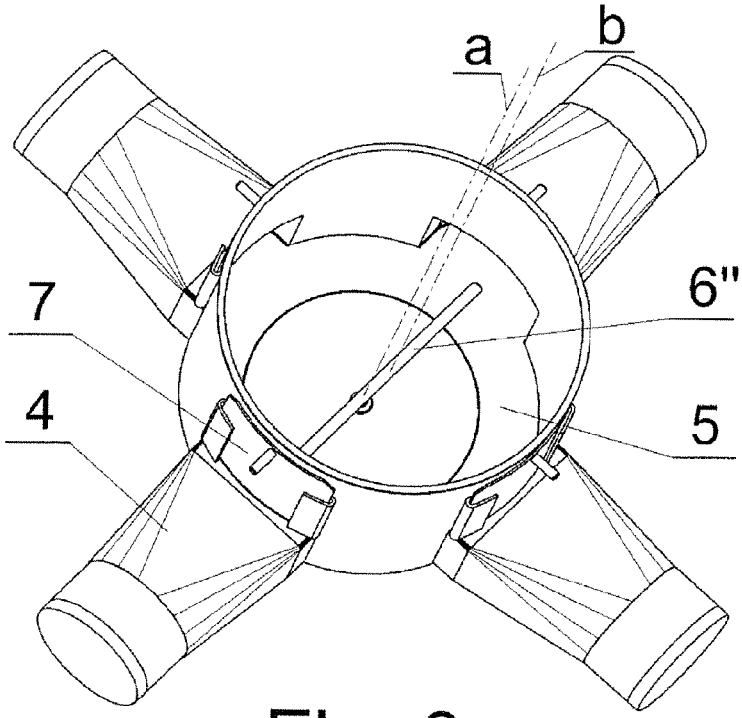
FIG. 3 shows a perspective view of a distribution chamber with an element for changing the local bulk density and disturbing the flow of the cut tobacco in the form of a horizontal rod.
Figure 4:
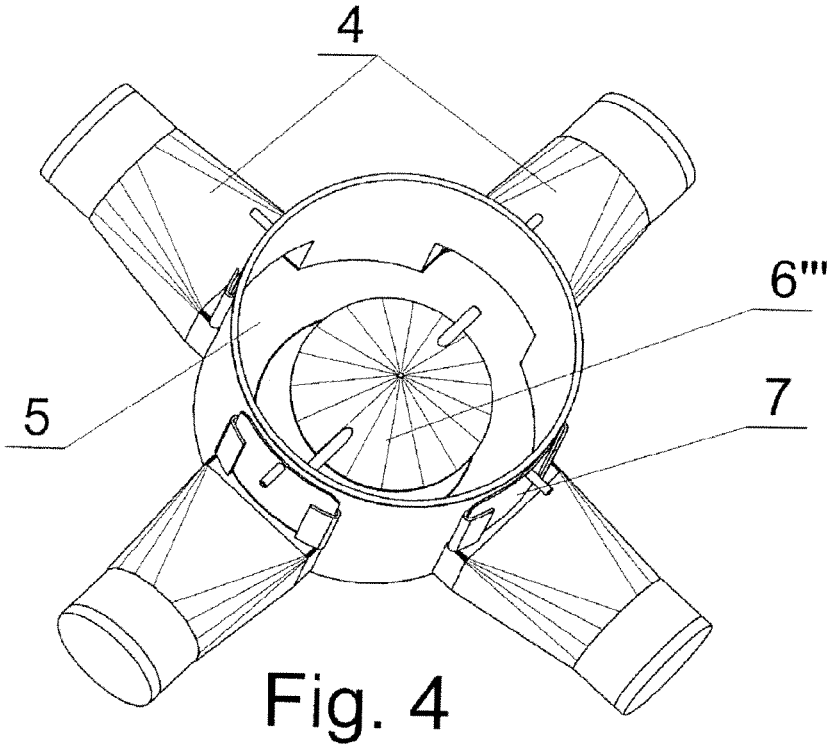
FIG. 4 shows a perspective view of a distribution chamber with an element for changing the local bulk density and disturbing the flow of the cut tobacco in the form of a cone and a horizontal rod connected to the cone.
Figure 5:
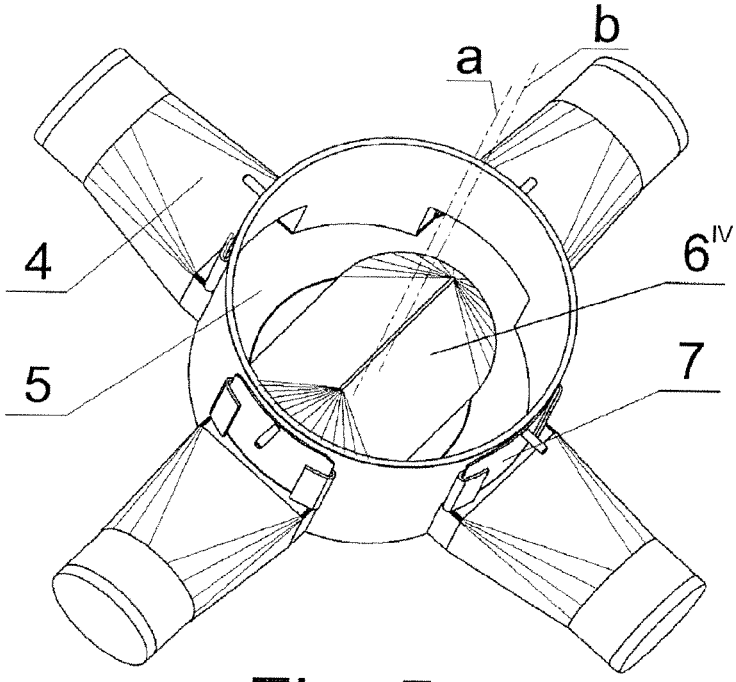
FIG. 5 shows a perspective view of a distribution chamber with an element for changing the local bulk density and disturbing the flow of the cut tobacco in the form of a combination of a prism having a triangular base and a cone cut with a plane passing through its axis of rotation, the corresponding halves of the cone being adjacent to the corresponding bases of the prism.
Figure 6:
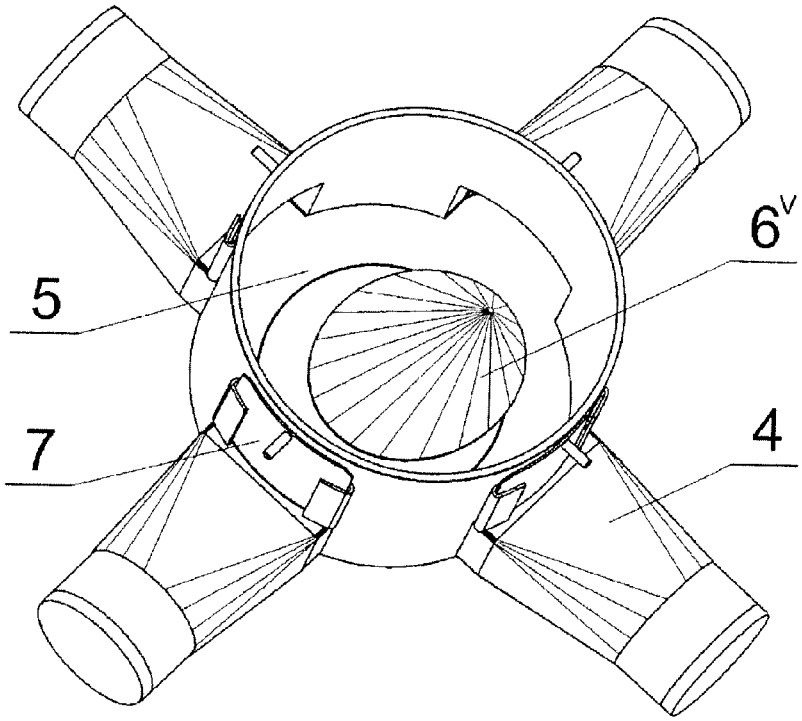
FIG. 6 shows a perspective view of a distribution chamber with an element for changing the local bulk density and disturbing the flow of the cut tobacco in the form of an inclined cone.
Figure 7:
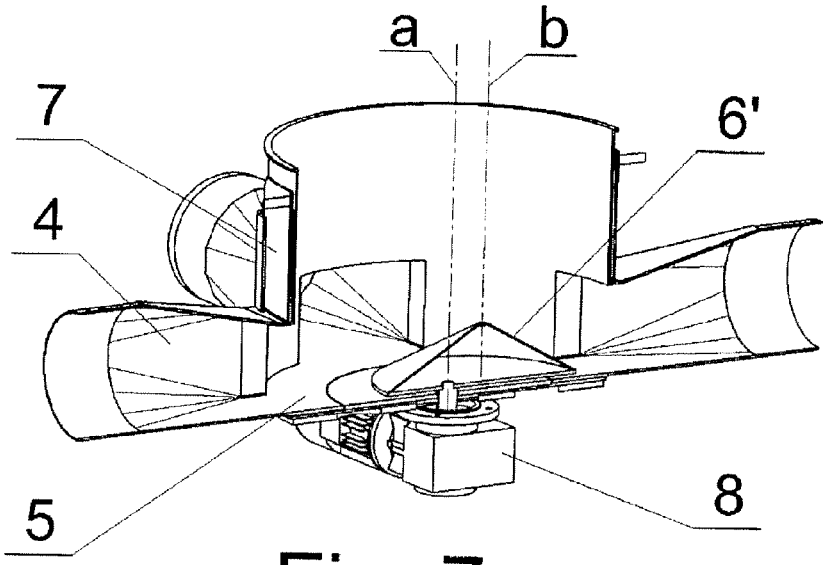
FIG. 7 shows a vertical section of the distribution chamber with the eccentrically mounted rotary cone of FIG. 2.

The element for changing the local bulk density and disturbing the flow of the cut tobacco is driven by a motor 8. The element rotates about the symmetry axis a of the distribution chamber 2, the axis being essentially perpendicular to the bottom of the distribution chamber. The element for changing the local bulk density and disturbing the flow of the cut tobacco may be formed by a cone 6', as shown in FIG. 2, or a rod 6" (FIG. 3). Another embodiment of the element for changing the local bulk density and disturbing the flow of the cut tobacco may be a combination of an essentially horizontally situated rod and a cone—the element 6''' (FIG. 4). One end of the rod is placed in the vicinity of the wall of the distribution chamber 2. The element for changing the local bulk density and disturbing the flow of the cut tobacco may be formed by a combination of a prism having a triangular base and a cone cut with a plane passing through its axis of rotation, the corresponding halves of the cone being adjacent to the corresponding bases of the prism—the element $\mathbf{6}^{IV}$ (FIG. 5), or an inclined cone $\mathbf{6}^{V}$ (FIG. 6).

During the operation of the device, the cut tobacco is delivered in a continuous manner via a feeding conveyor (not shown), from which it drops gravitationally into the distribution chamber 2 through the feeding channel 3, and the element for changing the local bulk density and disturbing the flow of the cut tobacco is working continuously. The inlets of the receiving channels 4, which are working at the moment, are exposed, i.e., the valves 7 are lifted and locked against dropping, and the inlets of the non-working channels are closed by the valves 7. In the receiving channels 4 connected to working cigarette-making machines, vacuum is produced relative to the feeding channel 3, this producing an air flow through the distribution chamber 2 to the receiving channel 4, in which the flow velocity reaches 19 m/s. After dropping into the distribution chamber 2, the cut tobacco is taken by the transporting air jet, divided into proper receiving channels 4, the flow of the air and the cut tobacco, which enters each receiving channel, being disturbed by the element for changing the local bulk density and disturbing the flow of the cut tobacco, which performs its motion before the inlet of each receiving channel 4, this in turn resulting in generation of local flow turbulences which prevent agglomeration of the tobacco fine particles within the distribution chamber 2.

Each of the receiving channels 4 operates in a non-continuous manner because of non-continuous operation of the tobacco hoppers located on the cigarette-making machines. Because of that, every receiving channel 4 is switched off from time to time, as well as the efficiency of feeding the cut tobacco by the feeding conveyor is decreased. However, until the moment when the efficiency of the feeding conveyor is adjusted to the new total throughput of the working receiving channels 4, some amount of the cut tobacco still enters the distribution chamber 2, this amount constituting a temporary excess of the cut tobacco. The action of the element for changing the local bulk density and disturbing the flow of the cut tobacco results in that this excess cut tobacco is not deposited in the chamber 2 since it will be loosened by this element and sucked off by the working receiving channels.

After a break in the operation, the distributing device 1 for distributing the cut tobacco is restarted. When the cigarette-making machine sends a signal of the demand for the cut tobacco, the element for changing the local bulk density and disturbing the flow of the cut tobacco is actuated, this loosening the cut tobacco stored in the distribution chamber 2, and then the feeding process may start, i.e., the vacuum in the receiving channel 4 is generated as well as the feeding conveyor is started which feeds the cut tobacco to the distribution chamber 2.

In this solution the bottom of the distribution chamber does not rotate, whereas only the eccentric element for changing the local bulk density and disturbing the flow of the cut tobacco is rotary mounted on the output shaft of a motoreducer. In the case of using a cone, the diameter of its base constitutes from ½ to ⅔ of the diameter of the distribution chamber, whereas its height constitutes from ½ to ⅔ of the diameter of the receiving channel 4, and the eccentric constitutes from ½ to ⅔ of the height of the cone. The apex angle of the cone is from 80° to 150°, e.g., 120°.

The presented solution may comprise 2, 3, 4 or more receiving channels 4, and the diameter of the distribution chamber 2 may be designed accordingly. The flow of the air and the cut tobacco through the distribution chamber 2 will be proportional to the number of the working cigarette-making machines out of the maximum number of the connected machines being fed.

The distance between the axis b of the element for changing the local bulk density and disturbing the flow of the cut tobacco and the symmetry axis a of the distribution chamber 2 is in the range 15-50 mm, preferably 32 mm.

The axis of rotation of the element for changing the local bulk density and disturbing the flow of the cut tobacco may be coaxial with the symmetry axis a of the distribution chamber.

We claim:

1. A device for distributing cut tobacco for feeding cigarette-making machines, equipped with a distribution chamber having a bottom, with a feeding channel for feeding the cut tobacco to the distribution chamber, the channel being connected to the chamber from above, with a plurality of receiving channels for receiving the cut tobacco from the distribution chamber, each of the receiving channels being connected to the chamber at the chamber side walls, wherein a rotary element for changing the local bulk density and disturbing the flow of the cut tobacco fed to the distribution chamber is eccentrically mounted in the distribution chamber to its stationary bottom.

2. A device according to claim 1, wherein the element for changing the local bulk density and disturbing the flow of the cut tobacco has the form of a cone.

3. A device according to claim 1, wherein the element for changing the local bulk density and disturbing the flow of the cut tobacco has the form of a rod arranged essentially horizontally.

4. A device according to claim 1, wherein the element for changing the local bulk density and disturbing the flow of the cut tobacco is an element in the form of a cone and a rod arranged essentially horizontally and connected to the cone.

5. A device according to claim 1, wherein the element for changing the local bulk density and disturbing the flow of the cut tobacco is an element being a combination of a prism having a triangular base and a cone cut with a plane passing through its axis of rotation, the corresponding halves of the cone being adjacent to corresponding bases of the prism.

6. A device according to claim 1, wherein the element for changing the local bulk density and disturbing the flow of the cut tobacco has a form of an inclined cone.

7. A device according to claim 3, wherein one end of the rod is placed in the vicinity of the wall of the distribution chamber.

8. A device according to claim 1, wherein the distance between the axis of the element for changing the local bulk density and disturbing the flow of the cut tobacco and the symmetry axis of the distribution chamber is in the range of 15-50 mm.

9. A device according to claim 1, wherein the axis of rotation of the element for changing the local bulk density and disturbing the flow of the cut tobacco is coincident with the symmetry axis of the distribution chamber.

10. A device according to claim 1, wherein an apex angle of the cones is in the range from 80° to 150°.

11. A device according to claim 4, wherein one end of the rod is placed in the vicinity of the wall of the distribution chamber.

12. A device according to claim 8, wherein the distance between the axis of the element for changing the local bulk density and disturbing the flow of the cut tobacco and the symmetry axis of the distribution chamber is 32 mm.

13. A device according to claim 10, wherein the apex of the cones is 120°.

14. A device according to claim 1, each of the receiving channels extending from the chamber side walls in a direction that is non-parallel to a rotational axis of the rotary element.

* * * * *